US006135800A

United States Patent [19]

Majors

[11] Patent Number: 6,135,800

[45] Date of Patent: Oct. 24, 2000

[54] ANTI-ROTATIONAL ELECTRICAL CONNECTOR

[75] Inventor: Brian C. Majors, Naperville, Ill.

[73] Assignee: Conxall Corporation, Villa Park, Ill.

[21] Appl. No.: 09/218,332

[22] Filed: Dec. 22, 1998

[51] Int. Cl.[7] ..... H01R 4/38

[52] U.S. Cl. ..... 439/321

[58] Field of Search ..... 439/321, 320, 439/469, 470, 318, 312, 313

[56] References Cited

U.S. PATENT DOCUMENTS

| | | | |
|---|---|---|---|
| 3,633,944 | 1/1972 | Hamburg | 285/81 |
| 3,742,427 | 6/1973 | Ballard . | |
| 3,917,373 | 11/1975 | Peterson . | |
| 4,154,496 | 5/1979 | Gallagher | 399/89 |
| 4,239,314 | 12/1980 | Anderson et al. . | |
| 4,257,663 | 3/1981 | Brush et al. . | |
| 4,268,103 | 5/1981 | Schildkraut et al. . | |
| 4,291,933 | 9/1981 | Kakaris . | |
| 4,304,456 | 12/1981 | Takaki et al. . | |
| 4,359,254 | 11/1982 | Gallusser et al. . | |
| 4,359,255 | 11/1982 | Gallusser et al. . | |
| 4,407,529 | 10/1983 | Holman | 285/82 |
| 4,462,653 | 7/1984 | Flederbach et al. . | |
| 4,477,022 | 10/1984 | Shuey et al. . | |
| 4,548,458 | 10/1985 | Gallusser et al. . | |
| 4,603,934 | 8/1986 | Burns . | |
| 4,703,988 | 11/1987 | Raux et al. | 439/321 |
| 4,708,663 | 11/1987 | Eckart | 439/469 |
| 4,793,821 | 12/1988 | Fowler et al. | 439/321 |
| 4,808,123 | 2/1989 | Dee et al. | 439/470 |
| 4,820,184 | 4/1989 | Brandes | 439/321 |
| 4,834,667 | 5/1989 | Fowler et al. | 439/321 |
| 4,838,805 | 6/1989 | Sturges | 439/321 |
| 4,900,260 | 2/1990 | Drogo | 439/321 |
| 4,984,995 | 1/1991 | Tucker et al. | 439/321 |
| 5,322,451 | 6/1994 | Guss, III et al. | 439/321 |
| 5,376,015 | 12/1994 | Fuchs et al. | 439/321 |
| 5,447,447 | 9/1995 | Guss, III et al. | 439/321 |

FOREIGN PATENT DOCUMENTS

| | | |
|---|---|---|
| 2136500 | 2/1973 | Germany . |
| 4205440 | 8/1973 | Germany . |
| 2840728 | 1/1980 | Germany . |
| 3625134 | 11/1987 | Germany . |
| 3209734 | 5/1989 | Germany . |
| 9212936 | 12/1992 | Germany . |
| 4301503 | 10/1993 | Germany . |

*Primary Examiner*—Lincoln Donovan
*Assistant Examiner*—Chandrika Prasad
*Attorney, Agent, or Firm*—Mayer, Brown & Platt

[57] ABSTRACT

An electrical connector having a male coupling assembly including a male coupling ring and a male connection insert and a female coupling assembly including an anti rotational washer and female connector insert. The male coupling assembly is equipped with interengaging portions which prevent rotational movement between the male coupling assembly and the male connector insert. The female coupling assembly includes interengaging portions which prevent rotational movement between the female coupling ring and the female connector insert.

32 Claims, 4 Drawing Sheets

ANTI-ROTATIONAL ELECTRICAL CONNECTOR

FIELD OF THE INVENTION

The present invention relates to electrical connectors. More particularly, the present invention is directed to an electrical connector that has a coupling member and electrical contact insert to be mated with a complementary electrical contact insert and a corresponding coupling member for providing a secure electrical connection that prevent unwanted rotation of the coupling members thereby inhibiting unintentional disconnection of the electrical contacts.

BACKGROUND OF THE INVENTION

As the use of electrical connections in manufacturing processes and products increased, it became apparent that in some applications the electrical connectors would unintentionally disconnect. One of the primary causes for the disconnection was found to be adverse conditions present in the environment where the electrical connectors were being used. The most common of these adverse conditions were generally identified as vibrational and rotational forces emanating from the environment surrounding the electrical connection which were acting on the coupling mechanisms and eventually causing the connector to disconnect. Some of the first attempts to combat these environmental forces included connectors with locking nuts. However, locking nuts were subject to loosening from vibrations as well. The use of set screws, locking washers, and adhesive solutions to prevent unintentional disconnection have also been utilized, however, these products, while providing solutions to the unintentional disconnection problem in some applications, also proved to be more expensive in that they required additional labor in their initial set up. Moreover, these "solutions" proved problematic and more expensive in those applications where intentional disconnection and reconnection of the electrical connector were needed because additional rework of the connector was often required. More recent attempts to solve the disconnection problem have included using a spring loaded projection on a portion of the connector which is then engaged with a portion of the nut. However, these attempt have been less than completely successful at preventing unintentional disconnection. As evidenced above, the prior art has various limitations and has not been completely successful at preventing unwanted rotation and loosening of the coupling mechanisms designed to maintain the electrical connector connected. As a consequence, machines, products, processes and other devices requiring these electrical connectors to function, do not operate properly due to disconnections and often require time consuming and expensive efforts to identify, locate, and repair the disconnection.

In view of the above, there remains a need for an electrical connector that is resistant to vibrational and rotational forces that originate from the environment where the electrical connector is located to prevent the unintentional disconnection of the electrical connector. The present invention addresses the shortcomings and limitations in the aforementioned prior art attempts at preventing unintentional disconnection of an electrical connector by providing a high strength, vibration resistant, and anti-rotational electrical connector assembly.

SUMMARY OF THE INVENTION

The purpose and advantages of the invention will be set forth in and apparent from the description and drawings that follow, as well as will be learned by practice of the invention. Additional advantages of the invention will be realized and attained by the elements of the apparatus particularly pointed out in the appended claims.

To achieve these and other advantages and in accordance with the purpose of the invention, as embodied and broadly described herein, the electrical connector assembly of the present invention includes a male coupling member having a first end including a threaded outer surface and a series of equally spaced axially extending notches disposed in a distal edge proximate the first end. Also included is a male insert adapted to be inserted in the male coupling member and configured to hold at least one electrical connector with at least one electrical contact. The male insert includes a radially outwardly extending flange disposed at one end, and a series of equally spaced bumps formed adjacent the radially outwardly extending flange and the outer surface of the male insert. The notches in the distal edge of the coupling ring are adapted to engage the series of equally spaced lumps to prevent movement of the male insert relative the male coupling member.

A female coupling member is provided having a threaded inner surface proximate one end and an inwardly directed radial flange having a series of equally spaced openings therethrough proximate the other end. The threaded inner surface is complementary to the threaded outer surface of the male coupling member. A female insert is adapted to be inserted in the female coupling member and configured to hold at least one electrical connector matable with the electrical connector of the male insert. The female insert further includes an abutment flange extending radially outward from the female insert and including a surface having a series of equally spaced hemispherical protrusions. A washer is provided and when the electrical connector is assembled, is disposed between the inwardly directed radial flange and the surface having a series of equally spaced hemispherical protrusion. The washer includes a first surface having a series of rigid fins. The fins are adapted to capture the hemispherical bumps between adjacent rigid fins. Also included is a second surface having a series of extensions configured to be inserted into the equally spaced openings of the female coupling member. As a result, when the electrical connector is assembled, the male insert is inhibited from movement relative to the male coupling member and the female insert is inhibited from movement relative the female coupling member.

It is to be understood that both the foregoing general description and the following detailed description are exemplary and provided for purposes of explanation only, and are not restrictive of the invention, as claimed.

BRIEF DESCRIPTION OF THE DRAWINGS

The accompanying drawings, which are incorporated in and constitute a part of this specification, illustrate the preferred embodiment of the invention, and together with the description, serve to explain the principles of the invention.

DETAILED DESCRIPTION OF THE PREFERRED EMBODIMENT

Figure 1:
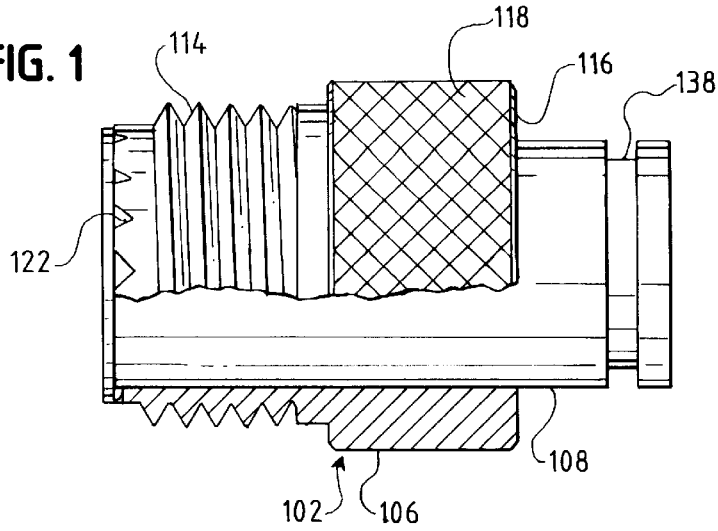
FIG. 1 is a side view of the male connector assembly made according to the present invention.

Reference will now be made in detail to the present preferred embodiment of the anti-rotational connector assembly, an example of which is illustrated in the accompanying drawings. Wherever possible, the same reference characters will be used throughout the drawings to refer to the same or like parts.

Figure 5:
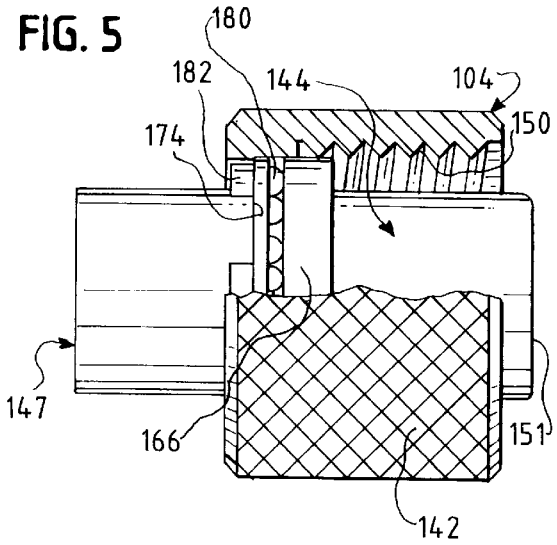
FIG. 5 is a side elevational view of the female connector assembly made according to the present invention.
Figure 10:
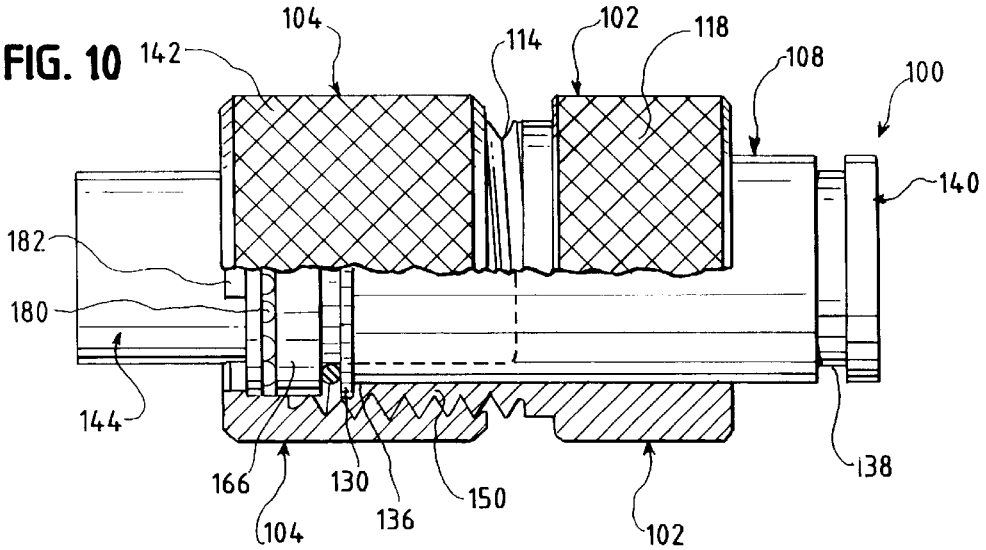
FIG. 10 is a side elevational view of the male connector assembly and the female coupling assembly connected together in accordance with the present invention.

An exemplary embodiment of the anti-rotational connector of the present invention is shown in FIG. 10 and designated generally by reference character 100. The anti-rotational connector of the present invention includes a male connector assembly 102 illustrated in FIG. 1 and the female connector assembly 104 illustrated in FIG. 5. Each of the male connector assembly 102 and the female connector assembly 104 may be used separately or together depending on the application.

As illustrated in FIGS. 1–4, the male connector assembly 102 made according to the present invention includes a male coupling ring 106 and a male contact carrier 108. The male coupling ring 106 is preferably made of aluminum and is generally cylindrical in shape and includes a smooth inner surface 110. The male coupling ring 106 may alternatively be made from plastic, ferrous material and non ferrous material. A first end 112 of the male coupling ring 106 has a threaded outer surface 114 adapted to be received by the female coupling ring assembly 104. The male coupling ring may also receive other conventional complementary coupling assemblies. The second end 116 of the male coupling ring 106 preferably includes a knurled outer surface 118 to form a gripping surface. Alternatively, the outer surface of the second end 116 may be of any texture. The distal edge 120 of the male coupling ring 106 proximate the first end 112 includes equally spaced notches 122 extending axially therein. It is preferred that the notches 122 be V-shaped although other configurations may be adopted. In the preferred embodiment, sixteen (16) equally spaced notches 122 are used.

Figure 2:
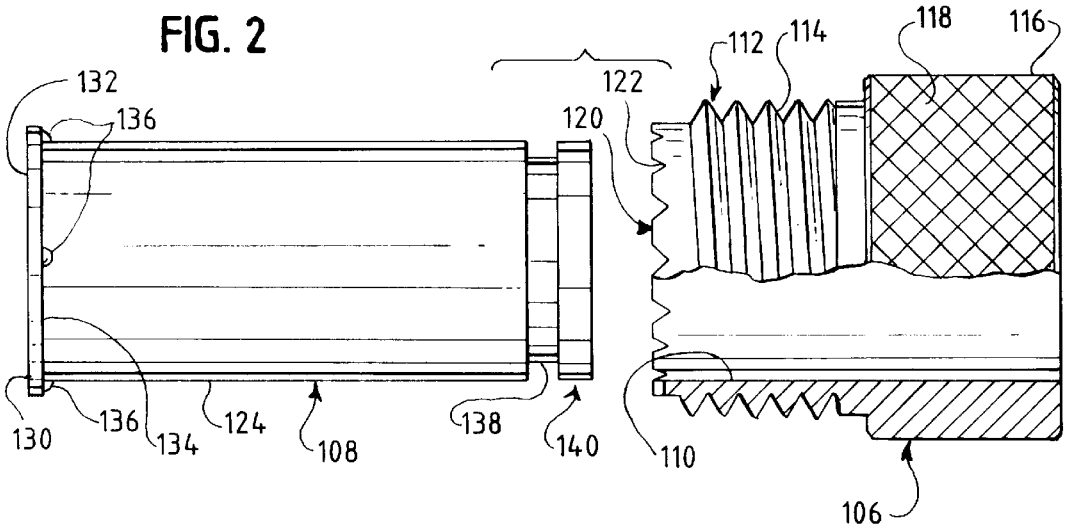
FIG. 2 is an exploded side view of the male connector assembly of FIG. 1, illustrating the male coupling ring and the male contact carrier.
Figure 3:
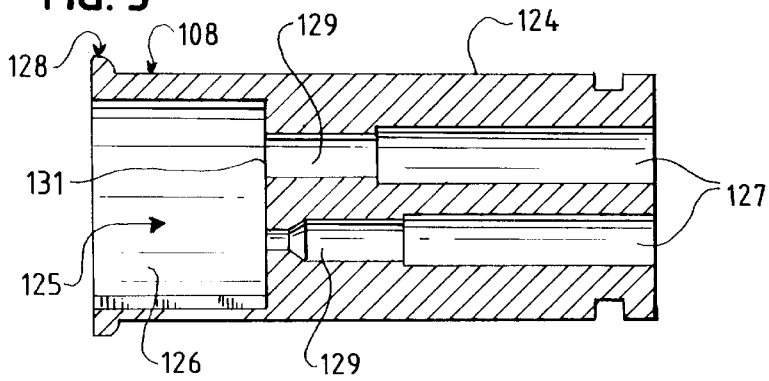
FIG. 3 is a side sectional view of the male contact carrier shown in FIG. 1.
Figure 4A:
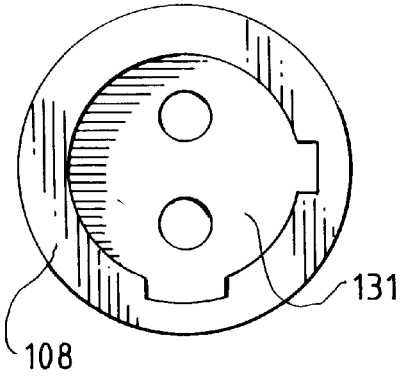
FIGS. 4*a–e* are end views of exemplary mating faces of the male contact carrier of FIG. 1.
Figure 4B:
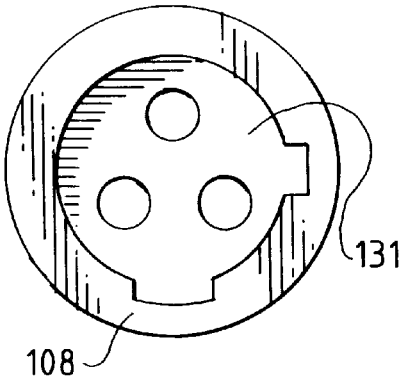
Figure 4C:
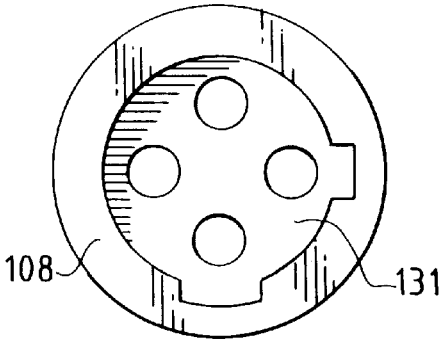
Figure 4D:
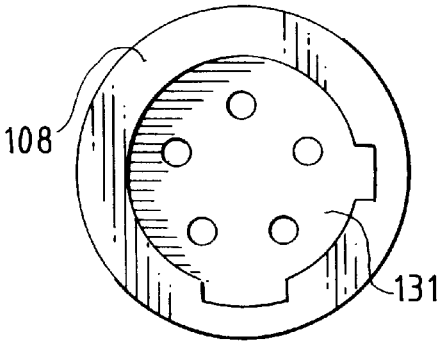
Figure 4E:
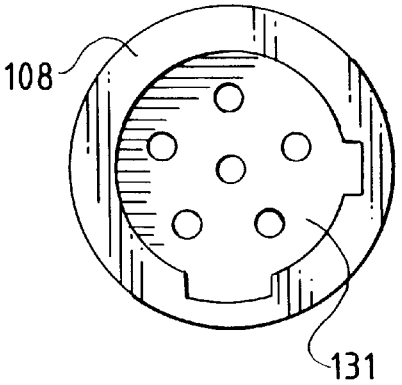

The male contact carrier 108 best illustrated in FIGS. 2 and 3 has a generally cylindrical body 124 and is sized to be inserted within the male coupling ring 106. The male contact carrier 108 is constructed of an insulating non-conductive material, preferably, substantially-noncompliant nylon, and is configured to hold one or more electrical contacts. The location where the electrical contacts are held is generally referred to as the mating portion 125. A chamber 126 is defined within a first end 128 of the male contact carrier 108 and is adapted to receive a mating portion of a corresponding female contact carrier. In addition, the male contact carrier 108 includes a rear chamber 127 that permits access for inserting wires and contacts into the mating portion 125. The male contact carrier 108 also includes smaller chambers 129 for receiving and holding conventional male contacts (not shown). The manner of wiring the contact is well known in the art and generally include inserting wires into the rear chamber 127 and connecting them to the contact being held in chamber 129. A portion of the contact extends beyond the rearward wall 131 of chamber 126 for insertion into or mating with corresponding contacts disposed in the female contact carrier. A cross section of an exemplary male contact carrier 108 is illustrated in FIG. 3. A series of exemplary mating faces that may be used as part of the male contact carrier 108 are disclosed in FIGS. 4*a–e*.

The male contact carrier 108 also includes a radial flange 130 extending outwardly from the first end 128 of the male contact carrier 108. The radial flange 130 includes a first surface 132 and a second surface 134. A number of raised bumps 136, spaced equally about the outer surface of the male contact carrier and shaped preferably as spherical quadrants are formed at the apex between the second surface 134 of the radial flange 130 and the outer surface 124 of the male contact carrier 108. The number of raised bumps 136 on the male contact carrier should be not greater than the number of V-shaped notches 122 on the distal edge of the male coupling ring. In the preferred embodiment, four (4) equally spaced bumps are used. In this manner, the V-shaped notches 122 receive and engage the raised bumps when an axial force is applied against the first surface 132 of the radial flange 130 so as to prevent rotational movement between male coupling ring 106 and the male contact carrier 108.

An annular groove 138 is disposed about the second end 140 of male contact carrier 108. The annular groove 138 is provided to increase surface area for adhesion and act as a mechanical retainer after overmolding the outer surface 124 with plastic or rubber.

A female connector assembly 104 made according to the present invention is best disclosed in FIGS. 5–8. The female connector assembly 104 includes a female coupling ring 142, a female contact carrier 144 and a washer 174.

Figure 7:
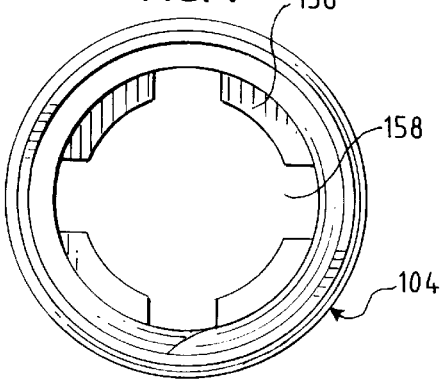
FIG. 7 is an end view of the female coupling ring.

The female coupling ring 142 is generally cylindrical and includes an outer surface 148 preferably knurled, and a threaded inner surface 150. The female coupling ring 142 is also preferably formed from aluminum. The female coupling ring may alternatively be made from plastic, ferrous material and non ferrous material. A first end 152 of the female coupling ring 142 is adapted to receive the threaded first end 112 of the male coupling ring 106. As best illustrated in FIG. 7, the second end 154 of the female coupling ring includes an inwardly-directed radial flange 156 having a series of equally spaced keyways 158 formed therein. In the preferred embodiment, four (4) equally spaced keyways 158 are used.

Figure 6:
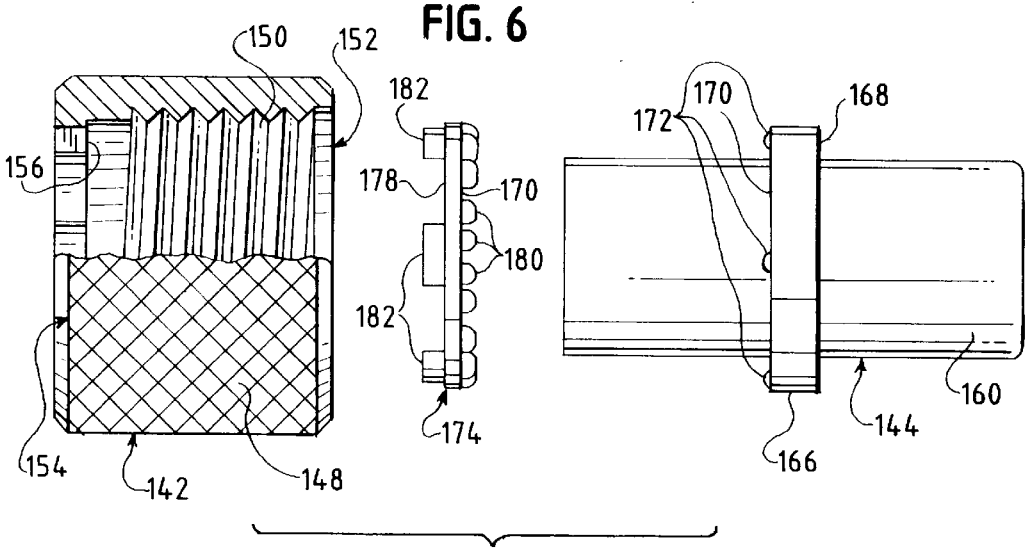
FIG. 6 is an exploded view of the female connector assembly of FIG. 5, illustrating the female coupling ring, the washer, and the female contact carrier.
Figure 8:
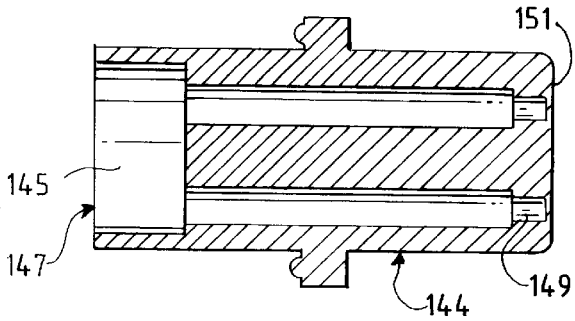
FIG. 8 is a side cross sectional view of the female contact carrier of FIG. 6.
Figure 9:
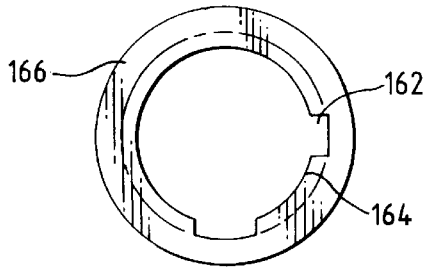
FIG. 9 is an end view of an exemplary mating face of the female contact carrier.

The female contact carrier 144 is best disclosed in FIGS. 6 and 8 is made of an insulating material preferably, substantially-noncompliant nylon and is configured to hold one or more electrical contacts. The female contact carrier 144 is of elongate, cylindrical shape and is sized to be inserted within the female coupling ring 142. The female contact carrier 144 includes a mating portion 160 formed therein complementary to the mating portion 125 formed in the chamber 126 of the male contact carrier 108. If desired, the chamber 126 and mating portion 160 may be formed with corresponding grooves 162 and ridges 164 for proper alignment therebetween as best seen in FIG. 9. The size and configuration of the mating portions will vary depending on the number of contacts necessary for the given application. As best illustrated in FIG. 8, the female contact carrier 144 includes a chamber 145 formed in the rearward end 147. The chamber 145 permits access for inserting wires and contacts into the mating portion 160. The female contact carrier also includes smaller chambers 149 for receiving and holding conventional female contacts (now shown). The female contacts generally do not extend beyond the forward 151 face of the female contact carrier.

The female contact carrier 144 also includes an abutment flange 166 extending radially outward from the body of the female contact carrier 144. The abutment flange 166 has a smooth first surface 168, adjacent the mating portion 160, which will engage the first surface 132 of the radial flange 130 of the male contact carrier 108 when the female connector assembly and the male connector assembly are joined. The abutment flange 166 has a second surface 170 opposite the first surface 168. The second surface 170 includes a number of equally spaced bumps 172, preferably hemispherical, and formed integrally thereon. In the preferred embodiment, four (4) equally spaced bumps are used.

The female connector assembly 102 also includes a washer 174. The washer 174 is located between the second surface 172 of the abutment flange 166 and the inwardly directed radial flange 156 of the female coupling ring 142 when the female connector assembly 102 is assembled. The washer 174 is a generally ring shaped member having opposing surfaces 176 and 178. The washer is made of an insulating material, preferably substantially noncompliant nylon. Surface 176, of the washer 174, when assembled with the female connector assembly, faces the second surface 170 of the abutment flange 166. Surface 176 includes axially extending symmetrical rigid fins 180. The rigid fins 180 are aligned radially about the washer 174 and appropriately spaced apart so as to capture each hemispherical bump 172 between two adjacent rigid fins 180 and, thus limit rotational movement of the washer 174 relative to the female contact carrier 144. In the preferred embodiment, sixteen (16) rigid fins are used. Surface 178 of the washer 174 is provided with a series of keys 182 preferably corresponding in configuration to the series of keyways 158 formed in the inwardly directed radial flange 156 of the female connecting ring 142. In the preferred embodiment, four (4) keys 182 are used. When the female coupling assembly 104 is assembled, and the hemispherical bumps 172 of the female contact carrier are captured between the radial fins 180 of the washer 174 and the keys 182 of the washer are received by the keyways 158 of the female coupling ring 142, rotational movement of the female coupling ring relative to the female contact carrier will be inhibited accordingly.

Figure 11:
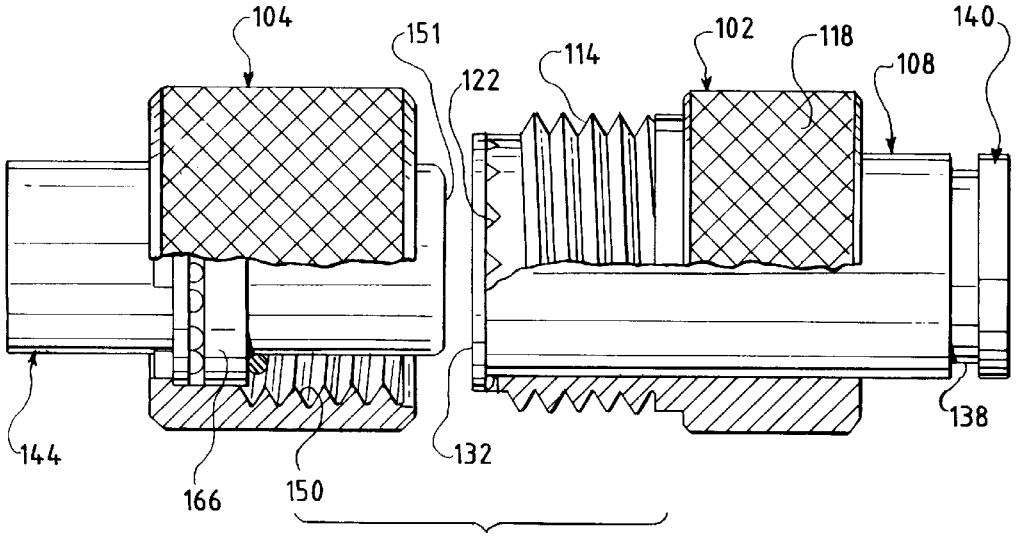
FIG. 11 is an exploded view of the male connector assembly and the female coupling assembly of FIG. 10.

A male coupling assembly 102 and a female coupling assembly 104, each made according to the present invention, when used together or separately provide an anti-rotational and anti-vibrational connector assembly. It should be understood that the male coupling assembly 102 and the female coupling assembly 104, each may be separately used in conjunction with complementary conventional assemblies for providing electrical connections. In operation, the male coupling assembly 102 and the female coupling assembly 104 are brought into a face to face relationship. As best illustrated in FIGS. 10 and 11, the first end 112 of the male contact carrier is moved over the mating portion 160 of the first end of the female contact carrier until the outer threaded portion 114 of the male coupling ring is brought into contact with the threaded inner surface 150 of the female coupling ring 142. Rotation of the threaded portions of the male and female coupling rings moves the male contact carrier and the female contact carrier axially into engagement until the first surface 132 of the male contact carrier 108 engages the second surface 168 of the abutment flange 168 disposed on the female contact carrier. When the coupling rings are fully engaged, the V-shaped notches 122 disposed on the distal edge of the male coupling ring 106 receive and engage the raised bumps 136 so as to prevent rotational movement between the male coupling ring 106 and the male contact carrier 108. Similarly, when the hemispherical bumps 172 of the female contact carrier 144 are captured between radial fins 180 of the washer 174 and the keys 182 of the washer 174 are received by the keyways 158 of the female coupling ring, rotational movement of the female coupling ring 104 relative to the female contact carrier 144 is inhibited.

Although reference has been made to the use of the present invention for the purpose of explanation, it is understood that alternative embodiments in accordance with the claims presented below are within the scope of the present invention. It also will be apparent to those skilled in the art that various modifications and variations can be made in the design and construction of the anti-rotational connector without departing from the scope or spirit of the invention.

Other embodiments of the invention will be apparent to those skilled in the art from consideration of the specification and practice of the invention disclosed herein. It is intended that the specification and examples be considered as exemplary only, with the true scope and spirit of the invention being indicated by the following claims.

What is claimed is:

1. An electrical connector assembly, comprising:

a male coupling member having a first end including a threaded outer surface and a series of equally spaced axially extending notches disposed in a distal edge proximate said first end;

a male insert adapted to be inserted in said male coupling member and configured to hold at least one electrical connector with one or more electrical contacts said male insert including a radially outwardly extending flange disposed at one end, and a series of equally spaced bumps formed adjacent the radially outwardly extending flange and the outer surface of said male insert;

a female coupling member having a threaded inner surface proximate one end and an inwardly directed radial flange proximate the other end having a series of equally spaced openings therethrough, said threaded inner surface complementary to said threaded outer surface of said male coupling member;

a female insert adapted to be inserted in said female coupling member and configured to hold at least one electrical connector with one or more electrical contracts matable with the at least one electrical connector of said male insert, said female insert including an abutment flange extending radially outward from said insert and including a surface having a series of equally spaced hemispherical protrusions;

a washer including a first surface having a series of rigid fins, said fins adapted to capture said hemispherical bumps between adjacent rigid fins, and a second surface having a series of extensions configured to be inserted into said equally spaced openings, said washer disposed between said inwardly directed radial flange and said surface having a series of equally spaced hemispherical protrusion when said electrical connector is assembled.

2. The connector assembly of claim 1 wherein said male insert is made of an insulating material.

3. The connector assembly of claim 2 wherein said insulating material includes substantially non compliant nylon.

4. The connector assembly of claim 1 wherein said male coupling member includes a second end having a textured outer surface.

5. The connector assembly of claim 1 wherein said axially extending notches are v-shaped.

6. The connector assembly of claim 1 wherein said equally spaced bumps are configured generally as spherical quadrants.

7. The connector assembly of claim 6 wherein said spherical quadrants are disposed at the apex between said flange and the outer surface of said male insert.

8. The connector assembly of claim 1 wherein said male insert includes an integrally formed inner chamber.

9. The connector assembly of claim 1 wherein said male coupling member is made of plastic, ferrous, or non-ferrous material.

10. The connector assembly of claim 1 wherein said female coupling member is made of plastic, ferrous or non-ferrous material.

11. The connector assembly of claim 1 wherein said female insert is made from an insulating material.

12. The connector assembly of claim 11 wherein said insulating material is substantially non compliant nylon.

13. The connector assembly of claim 1 wherein said other end of said female coupling member includes a textured outer surface.

14. The connector assembly of claim 1 wherein said washer is made from insulating material.

15. The connector assembly of claim 14 wherein said insulating material is substantially non compliant nylon.

16. A connector assembly comprising:

a male connector and a female connector, said male connector having a generally cylindrical body with an outer surface and having a first end and a second end, an inner chamber configured to hold at least one electrical contact and adapted to receive a portion of said female connector, an annular flange disposed on said first end, said annular flange including a first surface and an opposite second surface and a series of equally spaced protrusions disposed adjacent the second surface of said flange and said outer surface of said male connector;

a male coupling ring of generally cylindrical dimensions configured to receive said male connector, one end of said male coupling ring having a threaded outer surface, and a series of notches formed on the distal edge of the male coupling ring proximate said one end;

said female connector having a generally cylindrical body with a first end and second end, a mating portion formed adjacent said first end configured to hold at least one electrical contact and adapted to be inserted into said inner chamber of said male connector, an annular abutment flange extending radially outward from said female connector body, said abutment flange having a first surface adapted to engage said first surface of said male connector annular flange and an opposite second surface including a series of equally spaced bumps;

a female coupling ring of generally cylindrical dimensions configured to receive a portion of said female connector and having a threaded inner portion proximate a first end complementary to and adapted to receive the threaded outer surface of said male coupling ring and a second end having an inwardly directed radial flange including a series of equally spaced keyways formed therein;

a washer having opposing surfaces, one of said opposing surfaces including a series of axially extending rigid fins to capture said equally spaced bumps between adjacent rigid fins, said second opposing surface including a series of keys corresponding in configuration to said keyways and adapted to be inserted therethrough, whereby when said electrical connector is assembled, said male connector is inhibited from movement relative said male coupling member and said female connector is inhibited from movement relative said female coupling member.

17. The connector assembly of claim 16 wherein said male connector is made of an insulating material.

18. The connector assembly of claim 17 wherein said insulating material includes substantially non compliant nylon.

19. The connector assembly of claim 16 wherein said male coupling ring includes a second end having a textured outer surface.

20. The connector assembly of claim 16 wherein said axially extending notches are v-shaped.

21. The connector assembly of claim 16 wherein said equally spaced protrusions are configured generally as spherical quadrants.

22. The connector assembly of claim 21 wherein said spherical quadrants are disposed at the apex between the second surface of said flange and said outer surface of said male connector.

23. The connector assembly of claim 16 wherein said inner chamber is integrally formed with said male contact carrier.

24. The connector assembly of claim 16 wherein said coupling ring is made of plastic, ferrous, or non-ferrous material.

25. The connector assembly of claim 16 wherein said equally spaced bumps are hemispherical.

26. The connector assembly of claim 16 wherein said female coupling ring is made of plastic, ferrous, or non-ferrous material.

27. The connector assembly of claim 16 wherein said female connector is made from an insulating material.

28. The connector assembly of claim 27 wherein said insulating material is substantially non compliant nylon.

29. The connector assembly of claim 16 wherein said second end of said female coupling ring includes a textured outer surface.

30. The connector assembly of claim 16 wherein said washer is made from insulating material.

31. The connector assembly of claim 30 wherein said insulating material is substantially non compliant nylon.

32. A male electrical connector comprising:

a male coupling member having a first end including a threaded outer surface and a series of equally spaced axially extending notches disposed in a distal edge proximate said first end;

a male insert adapted to be inserted in said male coupling member and configured to hold at least one electrical contact, said male insert including a radially outwardly extending flange disposed at one end, and a series of equally spaced bumps formed adjacent the radially outwardly extending flange and the outer surface of said male insert.

* * * * *

UNITED STATES PATENT AND TRADEMARK OFFICE

CERTIFICATE OF CORRECTION

PATENT NO. : 6,135,800
DATED : October 24, 2000
INVENTOR(S) : Brian Majors

It is certified that error appears in the above-identified patent and that said Letters Patent is hereby corrected as shown below:

In claim 1, column 6, lines 53-54, please replace "electrical contracts" with --electrical contacts--.

In column 1, line 43, please replace "attempt" with --attempts--.

In column 4, line 24, please replace "not" with --no--.

In column 4, line 57, after "8" please insert --and--.

In column 5, line 8, please replace "now" with --not--.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*